United States Patent [19]

Flaherty

[11] 4,245,558

[45] Jan. 20, 1981

[54] INFRARED PROXIMITY FUZE ELECTRONIC AMPLIFIER

[75] Inventor: Michael Flaherty, Fullerton, Calif.

[73] Assignee: The United States of America as represented by the Secretary of the Navy, Washington, D.C.

[21] Appl. No.: 311,921

[22] Filed: Sep. 26, 1963

[51] Int. Cl.[3] ..... F42C 13/02

[52] U.S. Cl. ..... 102/213

[58] Field of Search ..... 102/70.2 P, 213; 250/83.3 IR, 338, 342

[56] References Cited

U.S. PATENT DOCUMENTS

| | | | |
|---|---|---|---|
| 2,060,206 | 11/1936 | Hammond, Jr. | 102/213 |
| 2,856,852 | 10/1958 | Hinman, Jr. et al. | 102/214 |
| 2,892,093 | 6/1959 | Henderson | 102/213 |
| 2,898,857 | 8/1959 | Hafstad et al. | 102/213 |
| 2,927,213 | 3/1960 | Marion et al. | 102/213 |
| 3,069,546 | 12/1962 | Buntenbach | 250/338 |
| 3,070,017 | 12/1962 | Clark | 102/213 |
| 3,112,399 | 11/1963 | Chew | 250/342 |
| 3,118,062 | 1/1964 | Ilgenfritz et al. | 250/338 |
| 3,161,771 | 12/1964 | Enborg et al. | 250/338 |

*Primary Examiner*—Charles T. Jordan

*Attorney, Agent, or Firm*—R. S. Sciascia; A. L. Branning

EXEMPLARY CLAIM

1. An electronic proximity fuze for a projectile comprising transducer means for converting infrared radiation to an electrical signal, amplifying means connected to said transducer for amplifying said signal, said amplifying means including automatic gain control means for decreasing the gain of said amplifying means upon occurrence of a slowly rising signal, electronic switch means, a source of electrical energy, a detonator, means connecting said switch means said source and said detonator in electrical series circuit, means connecting said amplifying means and said electronic switch means for closing said switch means upon occurrence of a rapidly rising signal of predetermined magnitude, said last named means operating to reduce said predetermined magnitude of the signal when said automatic gain control has decreased the gain of said amplifying means.

14 Claims, 10 Drawing Figures

INFRARED PROXIMITY FUZE ELECTRONIC AMPLIFIER

The invention described herein may be manufactured and used by or for the Government of the United States of America for governmental purposes without the payment of any royalties thereon or therefor.

This invention relates generally to infrared proximity fuzes for use in explosive bombs, projectiles, and missiles or the like and more particularly to a new and improved electronic transducer, amplifier and firing system therefor.

Originally infrared detectors took the form of two-terminal networks but the four-terminal bridge circuit to be described herein offers increased circuit efficiency. A balanced bridge circuit offers three advantages: (1) the bias supply noise will cancel out, (2) the bridge offers twice the normal electrical output for the same radiation level since the signal has two polarities, and (3) no external loaded resistance is required for the bridge detector. In order to optimize the signal to noise ratio of the detector the infrared sensitive lead selenide deposit has been arranged in a 50° arc within each quadrant, each arc being connected as an arm of a bridge circuit. In order to reduce detector cost manufacturing tolerances are such that the resistance of the detector leg at 75° F. may vary from unit to unit by a factor of 10 although each bridge unit is balanced. Further, since the inherent characteristics of lead selenide are such that the resistance thereof is down by a factor of 2 at +120° F. and up by a factor of 3 at −20° F. the detector resistance may vary by a ratio of 60:1 over the operational range required for most projectiles, i.e. from −20° F. to 120° F. Further, the signal output of the detector is down by a factor of 3 at +120° F. and up by a factor of 10 at −20° F. therefore the signal output from the detector will vary through a ratio of 75:1 within the specified operational temperature range.

It is generally desirable to have an infrared sensitive projectile initiate on miss-distances up to approximately 70 feet from an aircraft or the infrared source. In order to achieve such sensitivity of the infrared detector over a wide variety of jet targets, i.e. both single or multiple engine aircraft and different engine levels of operation from low thrust to afterburner operation, the intensity of the infrared radiation from the sun is generally sufficient to produce an output signal from the detector of sufficient magnitude to fire the projectile or missile. Therefore, the amplifier and firing circuit must be capable of discriminating between a sun signal and a signal created by a jet target and it is further desirable that the amplifier and firing circuit be capable of firing the projectile upon the occurrence of a jet target signal even in the presence of a sun signal.

It is therefore a general object of the present invention to provide an infrared transducer having an increased signal to noise ratio, an increased output signal for a given radiation level and a detector that does not require an external load resistance.

Another general object of the present invention is to provide an electronic amplifier and firing circuit which is capable of receiving the output of the infrared transducer and providing a firing pulse when the output signal from the transducer indicates the presence of a jet aircraft.

A more specific object of the invention is to provide a differential amplifier capable of converting the detector signal to a symmetrical signal which approximates a 400 cycle sine wave, the output thereof being relatively independent of the wide ratio of bridge detector impedance.

Another object is the provision of an amplifier for use with the infrared transducer and which is capable of maintaining a relatively constant gain over the operational temperature extremes which results in a wide variation in output signal from the detector.

A further object of the invention is the provision of an amplifier stage including an automatic gain control circuit which prevents the fire control circuit from producing a fire signal upon a slowly raising sun signal at the detector.

A still further object of the invention is the provision of a fire control circuit which is temperature compensated, which provides further sun-target discrimination yet produces a fire signal upon a detector output indicating a jet target even in the presence of a sun signal.

Other objects and many of the attendant advantages of this invention will become more readily appreciated as the same becomes better understood by reference to the following detailed description when considered in connection with the accompanying drawings in which like reference numerals designate like parts throughout the figures thereof and wherein.

Figure 8:
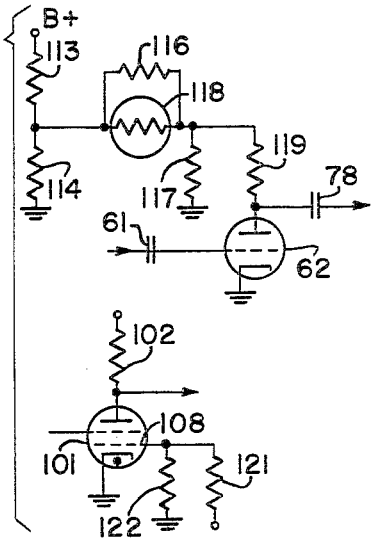
Figure 6:
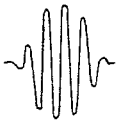
Figure 9:
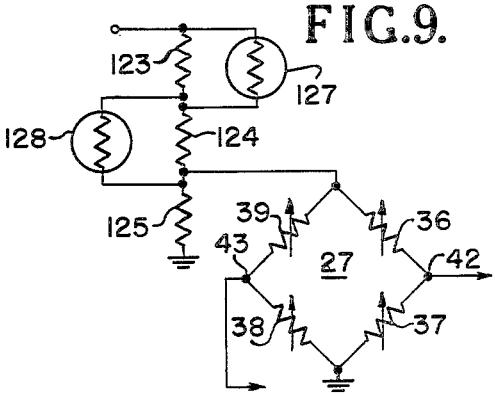
Figure 7:
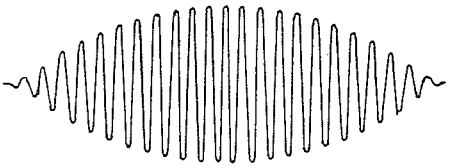
Figure 5A:
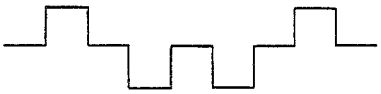
Figure 5B:
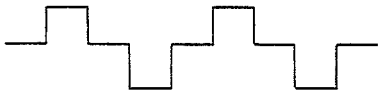

FIGS. 5*a* and 5*b* are a plots of the voltage as a function of time at a pair of points within the transducer;

FIG. 6 is a plot as a function of time of the output of the amplifier for a typical jet target signal;

FIG. 7 is a plot as a function of time of the output of the amplifier for a typical sun signal;

FIG. 8 is a modification of the schematic diagram of FIG. 6 illustrating another contemplated embodiment; and FIG. 9 is a second modification of the circuit diagram of FIG. 6 illustrating another modification of the invention.

Figure 1:
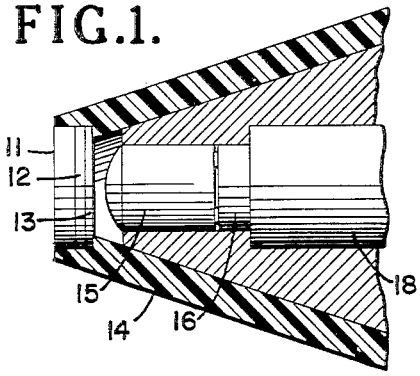
FIG. 1 illustrates a portion of a projectile partly in section and incorporating the present invention.

Referring now to the drawings and more particularly to FIG. 1 thereof, there is illustrated an optical system compatible with the transducer and the electronic amplifier and firing circuit which constitutes the instant invention. Briefly, the optical system comprises an outer window 11 which has sufficient strength to withstand the shock and vibrations occurring upon firing of the projectile from a gun and which contains a material which adapts it for transmission of infrared rays in the desired region, i.e. a wave length of 4.38 microns. The external surface of the window is treated with magnesium fluoride, or any other suitable coating, to act as an anti-reflection coating. Secured to the inner surface of window 11 is an interference filter 12 which has excellent transmission characteristics in the 4.38 micron wave length region. The interference filter, though having excellent characteristics in the 4.38 micron region and eliminating radiation of longer wave lengths, also permits passage of radiation in the 2.8 micron region. To eliminate this undesired transmission of the shorter wave lengths an absorption filter 13 is secured to the inner surface of the interference filter. The window, interference filter and absorption filter are secured within the casing 14 at the nose of the projectile by any suitable means.

A single, cylindrically shaped refracting lens 15 having a spherical shaped end is supported within the projectile immediately behind the absorption filter 13. Positioned behind the lens 15 is a detector comprising a cylindrical substrate of glass or other nonconducting material 16 having four annular sectors of infrared sensitive material 17, such, for example, as lead selenide, a plan view of the detector being illustrated in FIG. 2. As is apparent from FIG. 2 the lead selenide covers an angle of 50° in each quadrant with a 40° spacing between each arc. Also, secured within the projectile in any suitable container 18 is the infrared amplifier and firing circuit which forms, together with the detector and converter, the instant invention.

The location and width of the lead selenide deposit with respect to the lens determines the "look" angle, i.e. that angle at which the radiation source must be with respect to the projectile before radiation therefrom is focused on the sensitive detector area by the lens. For example, the look angle of one illustrative embodiment of an optical system suitable for use with the instant invention may be approximately an angle of 38.5° from the axis of the projectile and may have a total width of 3.5° at the detector half power points.

Figure 3:
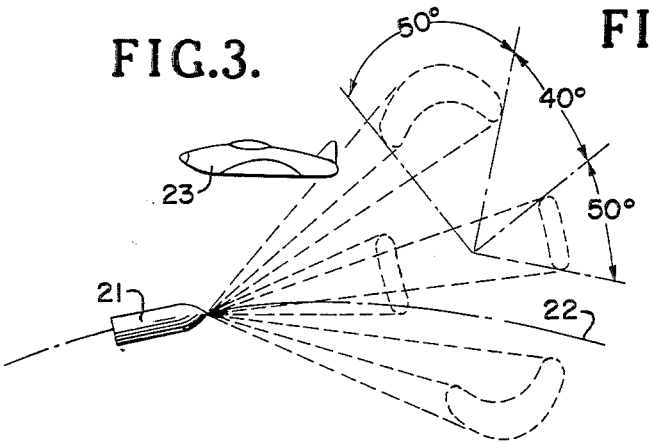
FIG. 3 is an illustration of a projectile incorporating the invention in flight and in lethal proximity to a jet target signal.

Referring now to FIG. 3 there is illustrated a projectile 21 as it travels along a trajectory 22 in the vicinity of an aircraft 23. The look area of the detector has been illustrated on the drawing in fathom and comprises four divergent arcs each 50° in length, having a width of approximately 3.5° at the half power points and having a look angle or divergence of 38.5° from the axis of the trajectory. The detector is designed for utilization with a spinning projectile having a rotation rate of approximately 200 rps. Thus, as the projectile spins about its axis, a point source of radiation, such, for example, as the jet plume of the aircraft 23 will be swept by each of the look areas at the rate of 200 times per second and radiation therefrom will fall in succession on each of the four detector segments.

As is well known to those skilled in the art carbon dioxide absorbs energy in the 4.38 micron wave length region. Thus, carbon dioxide which is uniformly distributed through the atmosphere with a density of approximately 0.03% absorbs not only radiation from the sun at this wave length but also absorbs the radiation from all other 4.38 micron wave length sources. Thus, as the detector is moved further away from a jet plume or other infrared signal the radiation therefrom is diminished. However, it has been found that sufficient radiation is present from the normal jet plume at the distance of greater than 70 feet, the lethal distance of the projectile, to produce a sufficiently high signal from the detector for satisfactory operation of the amplifying and firing circuit. At a distance of 70 feet the width of the look angle is relatively small and thus a jet plume passes through the field of view very rapidly even though the projectile and the jet aircraft are traveling in the same direction. Due to the optics of the system a source appears on the detector, that is, the lead selenide, as a point source and as it passes radially across one of the deposits the resistance decreases to a minimum as the point source reaches the center of the sector and then increases again to its quiescent value as the point source passes across the second half of the deposit. Thus when energized the output of the bridge varies in accordance with the bridge detector resistance. Therefore, at close range where the width of the look area is relatively small the length of the output signal from the detector is extremely short because of the relative velocities of the projectile and the target.

It may be that during a portion of the projectile's trajectory the sun may enter the field of view, the radiation of which passing through the optical system and falling on the detector is generally sufficient to produce an output great enough to fire the projectile. It is obvious, however, that at the distance of the sun the width of the field of view due to the 3.5° divergence from the 38.5° look angle is extremely large while the sun has a beam width of approximately one-half degree. Due to the extremely wide width of the look field at the distance of the sun and the low angular velocity of the projectile as it travels along its trajectory, the sun, as a heat source, travels through the field of view relatively slowly when compared to a jet signal traveling through the field of view at a distance of 70 feet or closer. It is this time differential which is utilized to discriminate between a jet and a sun signal.

Figure 4:
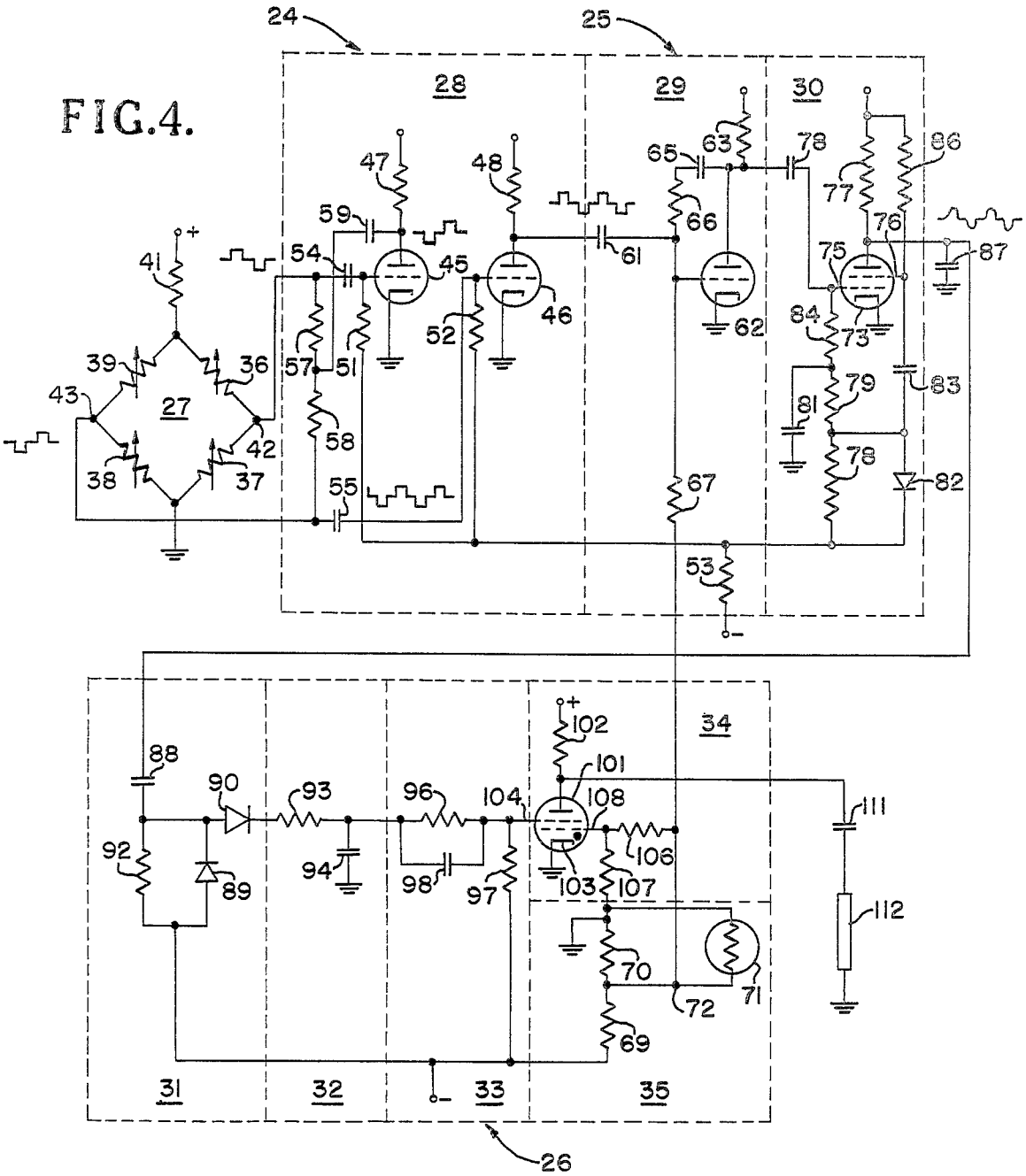
FIG. 4 is an electrical schematic diagram illustrating one exemplary embodiment of the transducer, amplifier and firing circuits contemplated by the invention.

Referring now to FIG. 4 there is illustrated a transducer circuit 24, an electronic amplifying circuit 25 and an electronic firing circuit 26 forming one embodiment of the instant invention. The transducer circuit 24 generally comprises the detector 27 and an inverting circuit 28 while the electronic amplifying circuit 25 generally comprises a temperature compensated amplifier 29, and an automatic gain control output amplifier 30. The firing circuit 26 generally comprises a voltage doubler 31, an integrator 32, a sun discrimination circuit 33, an electronic switch 34 and a temperature compensation network 35.

Figure 2:
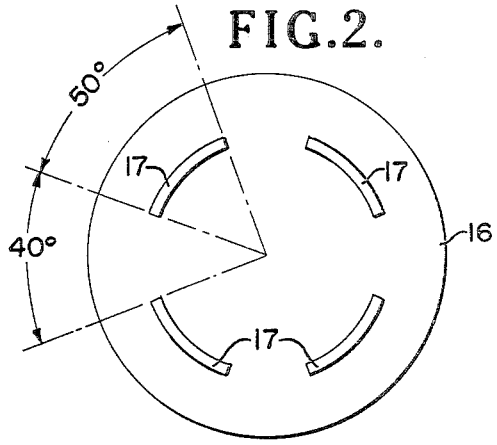
FIG. 2 is a plan view of the detector utilized in FIG. 1.

The lead selenide deposits 17 on the glass substrate 16 as illustrated in FIG. 2 are connected in series in such a manner as to form an electrical bridge circuit and are represented by variable resistors 36, 37, 38 and 39 of detector 27. The junction of resistors 36 and 39 is connected through a resistor 41 to a source of positive potential such, for example, as B+ and the junction of resistors 37 and 38 is connected to a point of common potential or ground. Junctions 42 and 43 thus represent the output terminals of the bridge with respect to ground.

For the sake of example let it be assumed that the projectile is spinning in such a manner that the detector is rotating in the counterclockwise direction. Assume that a point of infrared radiation initially enters the field of view of resistor 36 and the point beam of this radiation is directed at one edge of the deposit. As has been previously described, when the deposits of lead selenide are subjected to infrared radiation their resistance decreases thus, when the resistance of resistor 36 decreases the potential at output terminal 42 rises for a period of time determined by the spin velocity of the projectile. When the source leaves the field of view of resistor 36 the voltage at 42 drops back to its original bias level and remains until the source of radiation enters the field of view of resistor 37. When resistor 37 is subjected to radiation its resistance also decreases thus decreasing the voltage at terminal 42 to a value below its normal bias level. When the radiation source impinges resistor 38 the voltage at point 43 decreases creating a second negative pulse followed by a positive pulse which occurs when the radiation source strikes resistor 39. Thus, the output of the detector 27 for the sequence just described is a positive pulse followed by two negative pulses and a positive pulse as illustrated in FIG. 5*a*, the pulses having a width of 50 electrical degrees and a spacing of 40 electrical degrees, the sequence occurring at the rate of 200 cycles per second, i.e. the spin rate of the projectile. It can readily be seen that if the third and fourth pulses were inverted the frequency of the signal would be doubled as illustrated in FIG. 5*b*.

As has been hereinbefore described the sensitivity of the lead selenide deposits is greater at their center than at the edge, thus as a point source of radiation crosses the deposit radially the decrease in resistance becomes proportionally greater. Thus, as the projectile moves past the source of radiation or as the source of radiation goes through the field of view of the detector the amplitude of the pulses occuring at any terminal due to the radiation falling on the deposit within the field of view will increase during each revolution until the radiation is centered on the deposit and then will start to decrease. The output of the detector is thus an amplitude modulated 400 cycle pulse, the amplitude of which is determined by the relative position of the target within the field of view and by the duration of the pulse being determined by the velocity of the projectile with respect to the source of radiation.

FIG. 6 illustrates an output of the amplifying section for a typical jet plume while FIG. 7 illustrates the output of the amplifying section for a typical sun signal. The output has been illustrated in FIGS. 6 and 7 as an amplitude modulated sine wave because of the differentiation that occurs across the various coupling capacitors. The modulated output or the pulse output from the amplifying section for a jet target is much shorter than that of the typical sun signal because of the close proximity of the jet signal to the projectile, the relative velocities of the projectile and the jet aircraft and the narrow width of the look pattern at the distances within which the signal output of the detector is great enough to cause an output from the firing circuit. Because of the relatively low angular velocity and the extremely wide field of view at the distance of the sun as a result of the 3.5° divergence of the look angle, the width of the output pulse created by a sun signal is extremely long compared to that of a jet signal even though the amplitude of the pulse may be as great or even greater. It is this slowly rising characteristic of the sun signal which is utilized to discriminate between it and the rapidly rising pulse created by the normal jet signal.

Referring again to FIG. 4 it is the inverting circuit 28 which converts the output of the bridge illustrated in FIG. 5*a* to the signal illustrated in FIG. 5*b* and which provides a relatively constant amplitude signal to the temperature compensated amplifier 29 regardless of the impedance of the detector bridge 27 which varies over a wide range of resistance because of allowable manufacturing tolerances. The inverting circuit 28 generally comprises a pair of triodes 45 and 46 each utilized as an amplifier, triode 45 having its anode connected through resistor 47 to a source of positive potential such as B+ and its cathode connected to the point of common potential or ground while the triode 46 has its anode connected through resistor 48 to the source of positive potential and its cathode connected to the point of common potential. The grids of triodes 45 and 46 are negatively biased through resistors 51 and 52 respectively connected through resistor 53 to a source of potential that is negative with respect to ground. Output terminal 42 of detector bridge 27 is connected through capacitor 54 to the grid of triode 45 while output terminal 43 is connected through capacitor 55 to the grid of triode 46. Resistors 57 and 58 are connected in electrical series circuit between the output terminals 42 and 43 of bridge 27 to form a signal divider across the bridge. Capacitor 59 is connected from the anode of triode 45 to the midpoint of resistors 57 and 58 and forms a negative feedback path through resistor 57 to the grid of triode 45 and an output signal path through resistor 58 to the grid of triode 46. The output of the differential inverter stage 28 is taken from the anode of triode 46 and is capacitively coupled to the input of a temperature compensated amplifier 29.

As has been hereinbefore described when infrared radiation in the 43.8 micron wave length region strikes lead selenide the electrical resistance thereof decreases. Assume then that radiation strikes the sector comprising resistor 36 thus decreasing its resistance; the voltage at terminal 42 will rise driving the grid of triode 45 more positive, therefore increasing the current flow through the triode. An increased current flow increases the voltage drop across resistor 47 thus, a negative going signal appears at the anode of triode 45 and is fed back to the junction of resistors 57 and 58. The negative going signal is fed through resistor 57 back to the grid of triode 45 as a negative feedback signal and is applied through resistor 58 and capacitor 55 to the grid of triode 46. A negative going signal at the grid of triode 46 causes a decrease in the conduction of the tube and a resultant potential rise at the anode thus creating a positive going pulse at the input of the temperature compensated amplifier 29, each of the signals being illustrated at the appropriate point in the schematic of FIG. 4.

Assuming that the projectile is rotating at approximately a rate of 200 rps, in a counterclockwise direction, the source of radiation will next fall on resistor 37 causing a decrease in its resistance. A decrease in the resistance of resistor 37 causes a negative going signal to appear at the output of terminal 42 which is coupled through capacitor 54 to the grid of triode 45. The negative going signal is inverted by triode 45 and a positive going pulse is fed back through capacitor 59 and resistor 57 as a negative feedback signal and through resistor 58 and capacitor 55 to the grid of triode 46. A positive going signal on the grid of triode 46 produces a negative going pulse at its anode. Thus, the input to positive pulse followed by a negative pulse which is the desired signal as illustrated in FIG. 5*b*.

The radiation from the infrared source next falls on resistor 38 causing a decrease in its resistance and a resultant negative going pulse at the output terminal 43 as has been described and illustrated by FIG. 5*a*. This negative going signal is fed through capacitor 55 directly to the grid of triode 46 thus driving the grid more negative and producing a positive going signal at the anode. As the projectile completes a revolution the radiation strikes resistor 39 causing a decrease in its resistance and a resultant positive going signal at the output terminal 43 which is coupled through capacitor 55 thus producing a negative going pulse at the anode of triode 46. As the projectile revolves through a second revolution the sequence just recited is repeated, the amplitude of the various pulses increasing as the radiation source approaches the center of the field of view and decreasing as it proceeds to the other edge. It should be noted that by directly coupling terminal 43 of bridge 27 to triode 46 and by coupling terminal 42 to triode 46 through triode 45, an inversion of the output from terminal 43 takes place while the output at terminal remains uninverted thus resulting in a doubling of the output frequency of the detector and producing the desired 400 cps signal of FIG. 5*b* at the input to amplifier 29 when the projectile has a spin rate of 200 rps.

As has been hereinbefore described because of manufacturing tolerances the resistance of the bridge from unit to unit may vary over a range of approximately 10:1 at 75° F. In order to maintain a reasonable uniformity of operation between projectiles it is desirable that the output of the differential inverter stage be relatively independent of the wide ratio of bridge detector impedance. This relatively independent output is obtained by controlling the gain of triodes 45 and 46 in accordance with the impedance of the detector bridge; and, resistors 57 and 58 connected as a potential divider across the output terminals 42 and 43 of bridge makes possible the use of the detector resistance itself to control the gain.

When the detector resistance is low, the input signal to triode 45 for a given bridge output signal is higher but less of its output is fed to the input of triode 46 and when the detector resistance is high the input signal to triode 45 for a given bridge output signal is lower but the output thereof to triode 46 is proportionally greater. This is accomplished by utilizing a portion of the bridge detector as a potential divider across which the input to the triode 46 is produced. It will be noted that the output from triode 45 is applied through capacitor 59 to the junction of resistors 57 and 58. Resistors 58 and resistors 38 and 39 provide a potential divider to ground, the input to triode 46 being taken at the junction between resistor 58 and resistors 38 and 39, i.e. at junction 43. When the detector resistance is low the output of the detector unit at the grid of triode 45 for a given bridge output signal is high and the output of triode 45 is proportionally high. However, resistors 38 and 39 are also low and most of the output voltage from triode 45 is dropped across resistor 58 thus providing a lower potential above ground to be coupled through capacitor 55 to the input of triode 46. On the other hand, when the detector resistance is high, resistors 38 and 39 are high and, even though the input to triode 45 is lower, more of the output voltage produced at the anode of triode 45 is developed across resistors 38 and 39. Therefore more of the output signal from triode 45 is fed to triode 46. By this arrangement, i.e. by utilizing the detector resistance to determine the signal voltage division fed to triode 46, the peak-to-peak signal output of triode 46 is fairly independent of the wide ratio of the bridge detector resistance.

The output of triode 46 is coupled through capacitor 61 to the input of triode 62 connected as a conventional amplifier stage having an anode resistor 63, a negative feedback circuit consisting of capacitor 65 and resistor 66 and a grounded cathode. Grid bias for triode 62 is provided by the temperature compensating circuit 35 through resistor 67, the compensation circuit being arranged such that the amplifier 29 has a sharp gain reduction at −20° F. and a slight gain boost at +120° F. compared to +75° F. operation in order to compensate for the variation in the signal output of the detector at these temperature extremes.

Temperature compensation circuit 35 comprises a potential divider having resistors 69 and 70 serially connected between a point of negative potential and ground, resistor 70 being shunted by a negative temperature coefficient thermistor 71. The grid of triode 62 is connected through resistor 67 to the junction of resistors 69 and 70 and thermistor 71 such that a negative bias is normally applied thereto. As the operational temperature of the fuze decreases the resistance of thermistor 71 increases, a greater potential is dropped across the parallel combination of resistor 70 and thermistor 71 and the potential at junction 72 becomes more negative to decrease the gain of amplifier 29. Conversely, as the temperature of the fuze increases the resistance of thermistor 71 decreases to decrease the voltage drop across the parallel combination of resistor 70 and 71 to bring the junction 72 closer to ground thus increasing the gain of the amplifier. As has been hereinbefore set forth the signal output of the detector is increased by a factor of approximately 10 at −20° F. and is decreased by a factor of 3 at approximately +120° F. By appropriate selection of the resistance of resistors 69 and 70 and of the temperature-resistance characteristics of thermistor 71 the appropriate gain reduction at −20° F. and gain boost at +120° F. may be provided thus providing a substantially constant output at the anode of triode 60 over this wide range of temperatures.

The output from temperature compensated amplifier stage 29 is fed to the input of the output amplifier stage 30 which generally comprises a tetrode 73 having a control grid 75 and a screen grid 76. The anode of tetrode 73 is connected through resistor 77 to a source of positive potential, the cathode is grounded and control grid 75 is connected through capacitor 78 to the anode of triode 62. The output of amplifying stage 30 is provided with an automatic gain control circuit utilized to distinguish between a sun signal and a target signal. The automatic gain control circuit includes resistors 78 and 79 and capacitor 81 serially connected with resistor 53 between the point of common potential or ground and the source of negative potential. Diode 82 has its cathode connected to the junction of resistors 78 and 53 and its anode connected to the junction of resistors 78 and 79. The anode of diode 82 is also connected through capacitor 83 to screen grid 76. Resistor 84 is connected between the junction of capacitor 81 and resistor 79 and control grid 75 while resistor 86 is connected between the point of positive potential and screen grid 76.

In operation, capacitor 81 is charged through resistors 53, 78 and 79 such that the junction of capacitor 81 and resistor 79 is held at a negative potential, this potential being applied through resistor 84 to provide a negative bias to the control grid 75 of tetrode 73. This potential is adjusted to provide an optimum desired gain of the triode under normal operating conditions. The input to triode 62 illustrated on the drawing is inverted, amplified and capacitively coupled by capacitor 78 to the control grid of tetrode 73 and appears at the anode of tetrode 73 as substantially a 400 cps sine wave due to the differentiation characteristics of coupling capacitors 61 and 78. As is well known to those skilled in the art, the potential of the screen grid will follow the potential of the anode, therefore the 400 cycle wave is also applied through capacitor 83 to the anode of diode 82. It is apparent that as the anode of diode 82 is driven positive, diode 82 conducts to short this portion of the signal voltage to the negative voltage terminal. However, a negative going signal applied to the anode of diode 82 renders the diode nonconductive and provides a negative going signal at the junction of resistors 78 and 79. A negative going signal at this junction tends to charge capacitor 81 more negatively depending upon the amplitude of the applied signal and the RC time constant of resistor 79 and capacitor 81. It is apparent that as capacitor 81 is negatively charged the potential at the junction of resistors 79 and 84 and capacitor 81 is driven negative thereby increasing the negative bias on tetrode 73 to decrease the gain thereof.

Referring again to FIGS. 6 and 7, let it be assumed that a slowly rising sun signal such as that illustrated in FIG. 7 is applied to the control grid 75. As the amplitude of the signal begins to increase the negative pulses applied through capacitor 83 increase to charge the capacitor 81 in the negative direction. Charging of the capacitor 81 increases the negative bias on tetrode 73 to reduce the gain thereof thus decreasing the amplitude of the resultant output signal. On the other hand, if a signal indicating a jet plume occurs at the grid of tetrode 73, such as that illustrated in FIG. 6 due to the rapid rise of the signal, its short duration and because of the RC time constant of resistor 79 and capacitor 81 the negative bias on grid 75 does not appreciably change and the signal is amplified by tetrode 73 with a minimum of gain decrease. Thus, by appropriately arranging the RC time constant of the automatic gain control circuit the gain output of the output amplifier stage 30 can readily be decreased upon the occurrence of a slowly rising sun signal to such an extent that the amplitude thereof does not reach the fire amplitude of the electronic switch in the firing circuit while a target signal will pass amplified to the maximum desired extent. Even though the output of the amplifier upon a slowly rising sun signal reached the fire amplitude of the electronic switch, as will hereinafter become apparent, the time taken to reach this amplitude is increased thus increasing the discriminating characteristics of the sun-target discriminator circuit to be hereinafter described.

Across the output of tetrode 73 is placed a capacitor 87 utilized as a high frequency filter to eliminate microphonics from the various amplifier stages and to create an output signal which more closely approximates a 400 cycle sine wave. The output of amplifier stage 30 is connected as the input to voltage doubler 31 which comprises capacitor 88 and diodes 89 and 90 connected as a conventional cascaded voltage doubler except that the anode of diode 89 is connected to the source of negative potential with respect to ground and is by-passed by resistor 92. The circuit thus operates as a conventional voltage doubler except that capacitor 88 is charged to a value of the input voltage taken with respect to the negative potential rather than with respect to ground and the voltage at the cathode of diode 90 fluctuates between the peak-to-peak voltage output of amplifier stage 30.

The output of voltage doubler 31 is integrated by resistor 93 and capacitor 94, the output of integrator 32 being a pulse, the amplitude of which is dependent upon the amplitude of the input or the detector signal and the time rise of which is also dependent upon the time rise of the input signal thereto.

The output of integrator 32 is applied as the input to a second sun discriminating circuit 33 which comprises a pair of resistors 96 and 97 connected as a potential divider between the output of integrator 32 and the source of negative potential, resistor 96 being by-passed by capacitor 98.

Gas-filled tetrode or thyratron 101 acts as an electronic switch in the firing circuit for the projectile and has its anode connected through resistor 102 to a source of positive potential, its cathode 103 connected to ground and the control grid 104 connected to the junction of resistors 96 and 97 in the sun discriminating circuit 33. Resistors 106 and 107 are connected in a series circuit between junction 72 and ground potential to form a potential divider to which the screen grid 108 is connected. As is well known a positive going signal of sufficient amplitude applied to the control grid of a gas-filled tetrode operates to "fire" or cause conduction of the tetrode, the amplitude of the control grid signal necessary for "firing" being dependent upon the potential applied to the screen grid 108. If a target signal such as that illustrated in FIG. 6 appears at the output of amplifier 30, the output of the integrator 32 is a rapidly rising pulse, the major portion of which by-passes resistor 96 by virtue of by-pass capacitor 98 such that substantially the entire pulse appears across resistor 97 and thus is applied to the control grid 104. This positive going pulse raises the potential of control grid 104 sufficiently to allow conduction of tetrode 101 thus closing the electronic switch. On the other hand, if a sun signal such as that illustrated in FIG. 7 occurs the amplitude thereof appearing at the output stage of amplifier 30 is greatly decreased by virtue of the automatic gain control of this stage and the output signal from integrator 32 is a relatively slowly rising signal which is not passed by by-pass capacitor 98 and therefore divides across resistors 96 and 97 thus reducing the amplitude of the signal by the amount dropped across resistor 96. Thus, two separate circuits are provided which insure that the pulse appearing at the control grid 104 is not great enough to "fire" tetrode 101 upon occurrence of a sun signal. First, the output of the amplifier 30 is decreased for a slowly rising signal such as a sun signal and, second, the discrimination circuit 33 applies less of a slowly rising signal to the control grid 104 than it does on a rapidly rising signal such as the target signal.

Screen grid 108 of tetrode 101 is connected to the junction of resistors 106 and 107 which form a potential divider between junction 72 and ground to vary the negative bias applied to screen grid 108 in accordance with the operational temperature of the projectile. As has been previously stated the output of the detector is diminished by a factor of 3 at +120° F. such that the amplitude of a jet signal at the output of the amplifying circuit is reduced even though amplifying stage 29 is temperature compensated. However, as the temperature increases the potential at junction 72 becomes less negative thus bringing the screen grid potential closer to ground thereby increasing the potential difference between screen grid 108 and control grid 104. By increasing this difference in the potential, i.e. by decreasing the negative bias on screen grid 108, the amplitude of the positive pulse appearing at control grid 104 necessary to cause conduction of tetrode 101 is decreased, thus the sensitivity of the overall system remains substantially the same even though the signal output of the detector has decreased. Conversely, as the temperature decreases the potential on screen grid 108 becomes more negative thus decreasing the potential difference between control grid 104 and the screen 108 and requiring a larger amplitude positive pulse at the control grid 104 to "fire" the tetrode. This larger amplitude pulse is supplied by virtue of the fact that the amplitude of the output signal from the detector at extremely low temperatures is higher than that at ambient temperatures and the resultant pulse at grid 104 is higher even though the gain of triode 62 has been decreased.

Capacitor 111 and a detonator 112 are serially connected between the anode and cathode of tetrode 101 such that when tetrode 101 is nonconductive capacitor 111 is charged through resistor 102 and when tetrode 101 becomes conductive or the electronic switch closes, capacitor 111 is discharged through the tetrode and detonator 112 to initiate the projectile.

It is further apparent from a complete understanding of the amplifying and firing circuit that the system is effective to detonate the projectile upon the occurrence of a jet target even in the presence of a sun signal. Assume by way of example that the sun signal of FIG. 7 is present and has reached its point of maximum amplitude when the target signal of FIG. 6 occurs, i.e. they occur in about the time relationship as illustrated on the drawing. As has been previously described, the gain of output amplifier 30 is diminished upon a slowly rising sun signal and a minimum portion of the signal is by-passed by the by-pass capacitor 98 in the sun discriminating circuit 33 and the output of integrator 32 is divided across resistors 96 and 97. The potential at control grid 104 of tetrode 101 has thus risen by the amount of potential applied across resistor 97 but because of the decrease in the gain of amplifier 30 this increase in potential is not great enough to cause the tetrode 101 to fire. When the jet plume enters the field of view of the detector, the pulse of FIG. 6 appears at the input of amplifier 30 and is amplified and fed to the input of the firing circuit 26. Since the gain of output amplifier 30 has been diminished by the automatic gain control circuit the amplitude of the output pulse indicating a target is also diminished. The target pulse being a rapidly rising pulse is substantially passed by by-pass capacitor 98 in the discrimination circuit 28 and its entire amplitude appears across resistor 97 and is applied to grid 104. Since the grid 104 has already been driven in the positive direction by the presence of the sun signal the amplitude of a target signal appearing at the grid is sufficient to "fire" the tetrode even though the amplitude thereof is diminished by virtue of the reduced gain of amplifier 30.

On the other hand if a jet plane passes through the field of view beyond the normal fire distance such that the amplitude of the pulse applied by the amplifying circuit to the firing circuit under normal conditions would not be great enough to fire tetrode 101, the system will not fire even in the presence of a sun signal, because of the reduced gain of amplifier 30 since the output of amplifier 30 under these conditions is not great enough, even when added to the already reduced bias at grid 104 to drive the grid to the firing potential. Thus, by controlling the bias on the electronic switch in accordance with the presence of a sun signal, a target signal of substantially the same magnitude is required to fire the tetrode under both conditions.

Referring now to FIG. 8 there is illustrated a portion of the schematic diagram of FIG. 4 illustrating a second exemplary embodiment of the instant invention. In the second embodiment the temperature compensation is applied to the anode of triode 62 rather than to the control grid as in the embodiment of FIG. 4 and a fixed bias is applied to the screen grid of thyratron 101. The remainder of the circuit is identical to that of FIG. 4 and therefore has been omitted for the sake of simplicity. The temperature compensated amplifying stage of the second embodiment comprises a triode 62 having the output of the differential inverter stage capacitively coupled to its control grid through capacitor 61 and the output taken from the anode of triode 62 through capacitor 78. Resistors 113 and 114 are serially connected between the source of positive potential and ground and resistors 116 and 117 are serially connected across resistor 114. Resistor 116 is shunted by a negative temperature coefficient thermistor 118 and the anode of triode 62 is connected through resistor 119 to the junction of resistors 116, 117 and thermistor 118. Thyratron 101 is connected in the same manner as illustrated in FIG. 4 except that resistors 121 and 122 are serially connected between the source of negative potential and the point of common potential, the junction of these resistors being connected to the screen grid 108 of tetrode 101 such that a constant negative bias is placed on the screen grid.

In operation it is apparent that as the temperature of the projectile increases the resistance of thermistor 118 decreases thus increasing the current flowing through resistor 117 and raising the voltage at the junction of resistors 117, 116 and 118 to increase the potential applied to the anode of triode 62 thus increasing the gain thereof. As the temperature decreases the resistance of thermister 118 increases thus decreasing the potential applied to the anode and therefore decreasing the gain of the amplifier. As has been hereinbefore stated, the signal output of detector 27 increases as the temperature decreases and decreases as the temperature increases and since the gain of temperature compensate stage 62 varies inversely with the output of the detector and thus tends to compensate therefor. The operation of the remaining portion of the circuit is identical to that set forth in connection with the description of FIG. 4 except that the potential on the screen grid 108 of thyratron 101 is maintained constant and thus the amplitude of the input pulse necessary to fire the thyratron need not vary as the operational temperature of the projectile varies.

Referring now to FIG. 8 there is illustrated still another embodiment of the bridge detector utilizing a variable power supply to compensate for the change in signal output as a function of temperature. Resistors 123, 124 and 125 are serially connected between a point of positive potential and the point of common potential or ground, resistor 123 is shunted by thermistor 127 while resistor 124 is shunted by thermistor 128, the positive input terminal of the detector bridge 27 being connected to the junction of resistors 124, 125 and thermistor 128. The characteristics of a bridge detector utilizing lead selenide as the resistance elements is not only such that the output signal thereof varies as a function of temperature as has been hereinbefore described but the output signal is also a direct function of the applied voltage. Thus, as the voltage applied to the input terminals of the bridge decreases the output signal thereof decreases and as the input voltage increases the output signal increases for any given amount of radiation striking the detector. By appropriate selection of thermistors 127 and 128 the potential at the junction of resistors 124 and 125 may be varied in accordance with the temperature in such a manner as to compensate for the variations in output of the detector as the operating temperature thereof changes. It is apparent that both thermistors 127 and 128 may have negative temperature coefficient of resistance characteristics such that as the temperature decreases the resistance thereof increases to decrease the voltage at the junction of resistors 124 and 125 or that one thermistor may have a negative temperature coefficient and the other have a positive coefficient so that the combined characteristics thereof produce the appropriate decrease in potential at the junction of resistors 124 and 125 as the temperature decreases and the appropriate rise in potential as the temperature increases to compensate for the variation in output of the detector as a function of temperature.

There has been illustrated and described a new and unique transducer, amplifying and firing circuit particularly adapted to be utilized with a segmented lead selenide infrared bridge-type detector, the transducer circuit providing means for inverting a portion of the output of the detector such that the output thereof approximates a 400-cycle sine wave, the amplifier having at least one stage of the amplifier automatically decreased upon the occurrence of a sun signal while being unaffected by the occurrence of a jet target signal, the invention contemplating various methods of compensating for the variation in the output of the detector as a function of temperature.

While the invention herein has been described in connection with the particular illustrated embodiments it should be understood that various modifications and variations of the present invention are possible in light of the foregoing description. It is therefore to be understood, that within the scope of the appended claims, the invention may be practiced otherwise than as specifically illustrated and described.

What is claimed as new and desired to be secured by Letters Patent of the United States is:

1. An electronic proximity fuze for a projectile comprising transducer means for converting infrared radiation to an electrical signal, amplifying means connected to said transducer for amplifying said signal, said amplifying means including automatic gain control means for decreasing the gain of said amplifying means upon occurrence of a slowly rising signal, electronic switch means, a source of electrical energy, a detonator, means connecting said switch means said source and said detonator in electrical series circuit, means connecting said amplifying means and said electronic switch means for closing said switch means upon occurrence of a rapidly rising signal of predetermined magnitude, said last named means operating to reduce said predetermined magnitude of the signal when said automatic gain control has decreased the gain of said amplifying means.

2. An electronic proximity fuze for a projectile comprising a transducer for converting infrared radiation to an electrical signal, amplifying means for amplifying said signal, said amplifying means including automatic gain control means which operates to produce a greater gain for a rapidly rising signal and a lesser gain for a slowly rising signal, a thyratron, a detonator, a source of electrical energy, means connecting said thyratron, said detonator and said source in electrical series circuit, means connecting said amplifying means and said thyratron for initiating conduction of said thyratron when said amplified signal reaches a predetermined value, said last named means passing a rapidly rising signal substantially unattenuated but substantially attenuating a slowly rising signal, said last named means further reducing said predetermined value when said amplifying means is operating at a reduced gain.

3. An electronic proximity fuze for a projectile comprising transducer means for converting infrared radiation to an electrical signal, the output of said transducer varying as a function of temperature, amplifying means connected to said transducer for amplifying said signal, electrical switch means, a detonator, a source of electrical energy connected in electrical series circuit with said switch means and said detonator, means connecting said amplifying means and said switch means for closing said switch means upon occurrence of a rapidly rising signal of predetermined amplitude, temperature compensating means connected to said amplifying means and to said switch means for varying the gain of said amplifier and for varying said predetermined amplitude both as a function of temperature to compensate for the signal variation of said detector as a function of temperature.

4. An electronic proximity fuze for a projectile comprising a transducer for converting infrared radiation to an electrical signal, said signal decreasing with increased temperatures and increasing with decreased temperatures, amplifying means connected to said transducer for amplifying said signal, electrical switch means, means connecting said amplifying means and said switch means for closing said switch means when said signal reaches a predetermined value, temperature compensation means, means connecting said temperature compensation means and said amplifying means for decreasing the gain of said amplifying means as the temperature decreases and increasing said gain as temperature increases, means connecting said temperature compensation means to said electrical switch means for increasing said predetermined value as said temperature decreases and decreasing said predetermined value as said temperature increases, a detonator, a source of energy, and means connecting said source, said detonator and said electrical switch means in electrical series circuit.

5. An electronic proximity fuze for a projectile comprising a transducer for converting infrared radiation into an electrical signal, said signal varying as a function of temperature, amplifying means connected to said transducer for amplifying said signal, said amplifying means having a reduced gain upon occurrence of a slowly rising signal, an electronic switch, means connecting said amplifying and said switch means for closing said switch means upon the occurrence of a rapidly rising signal of predetermined amplitude, temperature compensating means connected to said switch means for varying said predetermined amplitude as a function of temperature in such manner as to compensate for variations in the output of said transducer as a function of temperature, and detonator means connected to said switch means for initiating the projectile when said switch is closed.

6. An electronic proximity fuze for a projectile comprising a bridge detector for converting infrared radiation into an electrical signal and having a pair of output terminals, a first amplifier having at least an input terminal and an output terminal, a second amplifier having at least an input terminal and an output terminal, means connecting one of said bridge output terminals to the input terminal of one of said amplifiers, means connecting the other of said output terminals to the input terminal of the other of said amplifiers, means connecting the output of said first amplifier to the input of said second amplifier such that the peak-to-peak output of said second amplifier is substantially independent of the impedance of said bridge detector, amplifying means connected to the output terminal of said second amplifier, a detonator, and means connected to said amplifying means for initiating said detonator.

7. An electronic proximity fuze for use in a projectile comprising a bridge detector having a pair of output terminals and converting an infrared radiation to an electrical signal, first amplifier means having an input terminal and an output terminal, second amplifier means having an input terminal and an output terminal, means connecting respective detector output terminals to the input terminal of the respective amplifiers, means connecting the output of said first amplifier to the input of said second amplifier, said last named means controlling the amplitude of the output of said first amplifier supplied to the input of said second amplifier to maintain the output of said second amplifier substantially independent of the bridge detector impedance, third amplifying means connected to said second amplifier, said third amplifying means decreasing gain upon slowly rising input signals, electronic switch means, means connecting said third amplifying means and said electronic switch means for rendering said switch means conductive upon occurrence of a rapidly rising signal of predetermined amplitude, and means connected to said switch means for detonating the projectile upon conduction of said switch means.

8. A detector for use in a spinning projectile comprising a substrate, four annular segments of electrical resistance material deposited on said substrate, the electrical resistance of said material varying as a function of the intensity of infrared radiation impinging thereon, means connecting said segments to form an electrical bridge circuit having a pair of input terminals and a pair of output terminals whereby when said detector is rotated a point source of radiation may be focused on said segments in succession.

9. A transducer for use in a spinning projectile comprising a substrate, four infrared sensitive resistors circumferentially arranged on said substrate, means connecting adjacent resistors on said substrate to form an electrical bridge circuit having a pair of input terminals and a pair of output terminals, and means connected to said output terminals for inverting the output from one of said terminals whereby the output frequency of said detector as said detector is rotated is doubled.

10. A transducer for use in a rotating proximity fuze comprising an electrical bridge circuit having a pair of output terminals, said bridge circuit converting infrared radiation to an electrical signal, first and second amplifier means each having at least an input and an output terminal, means connecting one of the output terminals of said bridge to the input terminal of said first amplifier means, means connecting the other output terminal of said bridge to the input terminal of said second amplifier means, and means connecting the output of said first amplifier means to the input of said second amplifier means whereby the output frequency of said bridge is doubled and the output of said second amplifier means remains substantially independent of the bridge impedance.

11. A transducer for use in a rotating proximity fuze comprising four infrared sensitive electrical resistors connected to form an electrical bridge circuit having a pair of input terminals and a pair of output terminals, each of said resistors changing electrical resistance in response to infrared radiation impinging thereon, first and second amplifier means each having at least an input terminal and an output terminal, a pair of resistors serially connected between the pair of output terminals of said bridge, means connecting one of the output terminals of said bridge to the input terminal of said first amplifier means, means connecting the other of the output terminals to the input terminal of said second amplifier means, and means connecting the output terminal of said first amplifier means to the junction of said pair of resistors whereby the output of said second amplifier means is relatively independent of the impedance of said bridge.

12. An electronic proximity fuze for use in a rotating projectile comprising a transducer for converting infrared radiation to an electrical signal, said signal having a frequency of approximately double the rotation rate of the projectile and an amplitude proportional to the position and intensity of a radiation source disposed at a distance therefrom, amplifier means connected to said transducer for amplifying the output thereof, said amplifying means including gain control means for reducing the gain thereof upon a slowly rising signal, voltage doubler means connected to said amplifier means for doubling and detecting the output of said amplifier means, integration means connected to said voltage doubler means for integrating the output thereof, electronic switch means, means connecting said integrating means and said electronic switch means for closing said switch means when a rapidly rising pulse of predetermined amplitude occurs at the output of said integrating means, and means connected to said electronic switch means for detonating the projectile when said electronic switch is closed.

13. The electronic fuze of claim 12 further including means connected to said amplifier means and to said electronic switch means for varying the gain of said amplifier means as a function of temperature and for varying said predetermined amplitude as a function of temperature.

14. The electronic fuze of claim 12 further including means connected to said transducer for compensating the output thereof as a function of temperature.

* * * * *